United States Patent [19]

Taylor

[11] 3,978,684

[45] Sept. 7, 1976

[54] REFRIGERATION SYSTEM

[75] Inventor: David H. Taylor, Bloomington, Minn.

[73] Assignee: Thermo King Corporation, Bloomington, Minn.

[22] Filed: Apr. 17, 1975

[21] Appl. No.: 569,035

[52] U.S. Cl. ..... 62/324; 62/428

[51] Int. Cl.[2] ..... F25B 13/00; F25D 17/06

[58] Field of Search ..... 62/278, 324, 325, 428, 62/173, 155, 236

[56] References Cited

UNITED STATES PATENTS

| | | | |
|---|---|---|---|
| 2,293,482 | 8/1942 | Ambrose | 62/324 |
| 2,932,178 | 4/1960 | Armstrong et al. | 62/428 |
| 3,105,366 | 10/1963 | Atchison | 62/428 |
| 3,203,196 | 8/1965 | Malkoff | 62/428 |
| 3,392,541 | 7/1968 | Nussbaum | 62/324 |
| 3,529,659 | 9/1970 | Trask | 62/324 |
| 3,777,508 | 12/1973 | Imabayashi et al. | 62/324 |

*Primary Examiner*—Lloyd L. King
*Attorney, Agent, or Firm*—C. F. Renz

[57] ABSTRACT

The invention relates to a system that can provide the refrigeration function of a compression refrigeration system, or by changing the position of some valves in the system, the system can provide a defrost function, or a heating function, or a capacity controlled refrigeration function. To accomplish the defrost or heating function compressed refrigerant is condensed in a heat exchanger that is in heat exchange relationship with a main evaporator and the liquid refrigerant thus formed passes through an expansion valve to an auxiliary evaporator. When the system operates to provide a capacity controlled refrigeration function, the capacity of the main evaporator is controlled by heat of compression from the heat exchanger that is in heat exchange relationship with the main evaporator. The amount of heat from this heat exchanger that counteracts the cooling effect of the main evaporator can be varied by dissipating a variable amount of the heat of compression before it reaches this heat exchanger. When performing the capacity control function, liquid refrigerant from the heat exchanger passes through an expansion valve to the main evaporator.

8 Claims, 5 Drawing Figures

REFRIGERATION SYSTEM

CROSS REFERENCES TO RELATED APPLICATIONS

So far as known, this application is not related to any pending patent application.

BACKGROUND OF THE INVENTION

In modern transportation of food a wide range of temperature levels must be maintained depending upon the particular food. It is important that the heating or cooling obtain an accurate desired temperature. When defrosting is needed it should be completed as rapidly as possible. To avoid error the manual adjustment that must be made by the operator should be as simple as possible, and it is desirable to have a single system that can perform a number of functions and the operation can be changed by the operator changing the setting of a single disc.

PRIOR ART

U.S. Pat. No. 2,515,842, Swinburne, discloses a bus air conditioning system where air is drawn through an evaporator 7 and then through a reheat coil 8.

U.S. Pat. No. 2,876,630, Boling, discloses a refrigeration system in which an evaporator is defrosted by sending hot compressed refrigerant to a set of tubes 40 where it is condensed and the liquid refrigerant passes through an expansion valve 34 and evaporates in a set of tubes 38 that surround tubes 40.

U.S. Pat. No. 2,909,907, Swanson, discloses a first evaporator coil 19 that is defrosted by heat from compressed refrigerant in a coil 21. From coil 21 refrigerant passes through a short restrictor 37 to a second evaporator coil 21 and back to a compressor 28.

U.S. Pat. No. 2,987,083, Crotser et al., discloses an evaporator 15 that is defrosted by hot compressed gas pumped to a defrosting tube 19. The defrosting tube 19 leads to a reheating tube 21 that connects to a restrictor 22 that leads to a suction line 17.

However, none of the references discloses a system that can accomplish either of the following operations: (a) a heat exchanger, located adjacent a main evaporator receives compressed refrigerant to defrost the main evaporator, or heat air to be conditioned, and the refrigerant that is condensed to a liquid in the heat exchanger is sent through an expansion valve to an auxiliary evaporator, said auxiliary evaporator being heated by ambient air, waste heat, an electric heater, or a eutectic heat holdover, or (b) compressed refrigerant is pumped first through a first heat exchanger from which a variable amount of heat can be dissipated, then to a second heat exchanger adjacent a main evaporator so as to counteract the cooling effect of the main evaporator, and the refrigerant condensed to a liquid in the two heat exchangers is sent through an expansion valve to the main evaporator.

SUMMARY OF THE INVENTION

Disclosed is a refrigerating and heating system which is particularly well suited for use in the transport refrigeration industry. The system can operate as a compression refrigeration cycle using a conventional main evaporator. By operating one three way valve and two solenoid operated valves the system can be changed from operating as a conventional refrigeration cycle to a heating cycle, or defrosting cycle. The heating and defrosting are accomplished by compressed refrigerant being pumped to a heat exchanger that is in heat exchange relation with both a drain pan for the main evaporator and with the main evaporator. During the heating or defrosting cycles, refrigerant is cut off from the main evaporator. In the heat exchanger that gives off heat for heating or defrosting, the compressed refrigerant is condensed. The liquid refrigerant is then passed through a restrictor to an auxiliary evaporator. The auxiliary evaporator can be heated by ambient air, or for more rapid evaporation it can be surrounded by a heat holdover or it can be heated by waste heat or electric heat.

By leaving the three way valve in the same position as in the heating or defrost cycle and changing the positions of the two solenoid operated valves the system can operate as a capacity controlled refrigeration cycle. Refrigerant will pass from the compressor through a first heat exchanger where a variable amount of the heat of compression can be dissipated. The refrigerant then passes to the heat exchanger that is in heat exchange in heat exchange relationship with the main evaporator. This heat exchanger in heat exchange relationship with the main evaporator can be termed a second heat exchanger and any refrigerant that is not condensed in the first heat exchanger will be condensed in the second heat exchanger. The liquid refrigerant passes from the second heat exchanger through a restrictor to the main evaporator. The capacity of the main evaporator is thus reduced by receiving heat from the second heat exchanger. The amount of heat given off by second heat exchanger to counteract the cooling effect of the main evaporator will vary with the heat of compression dissipated in the first heat exchanger.

DESCRIPTION OF THE PREFERRED EMBODIMENT

Figure 1:
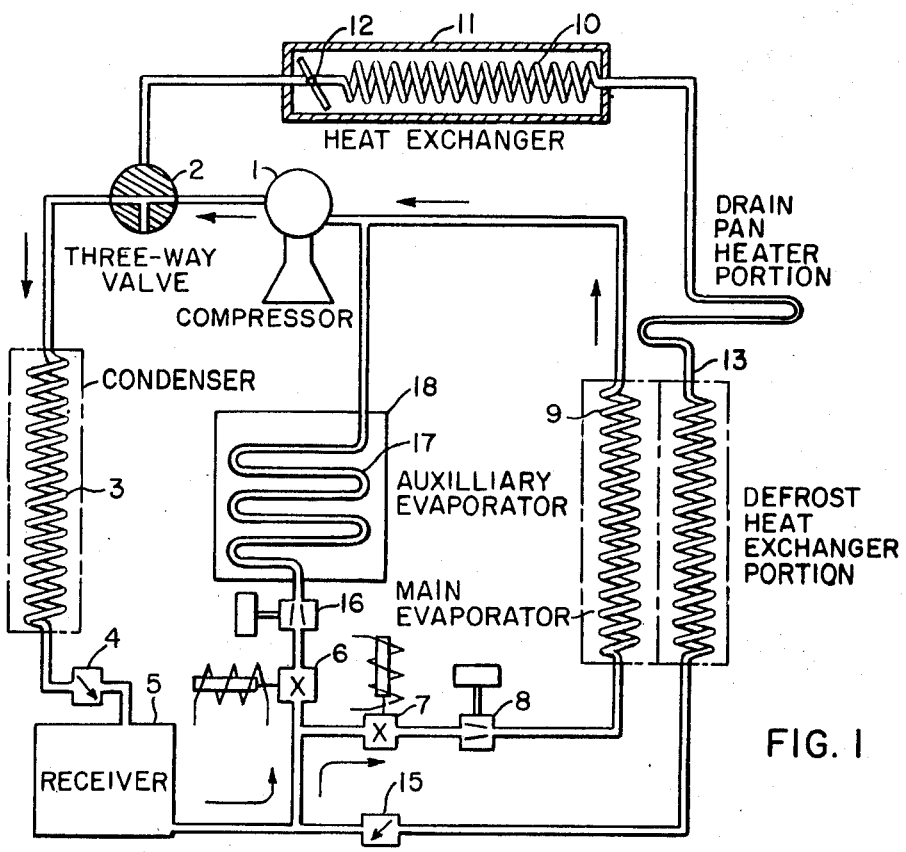
FIG. 1 is a schematic diagram of a system having valves therein set so the system will operate as a conventional refrigeration cycle.

FIG. 1 of the drawings shows a system having valves therein set so the system will operate as a conventional refrigeration cycle. The long arrows indicate the direction of flow of the refrigerant. Refrigerant is compressed in a compressor 1 and is pumped through a three way valve 2 to a condenser 3. The refrigerant condenses to a liquid in condenser 3 and passes through a check valve 4 to a receiver 5. In the cycle of FIG. 1, a solenoid operated valve 6 is closed and a solenoid operated valve 7 is open so the liquid refrigerant passes from receiver 5 through an expansion valve 8 to a main evaporator 9. From main evaporator 9 the refrigerant vapor returns to compressor 1.

Figure 2:
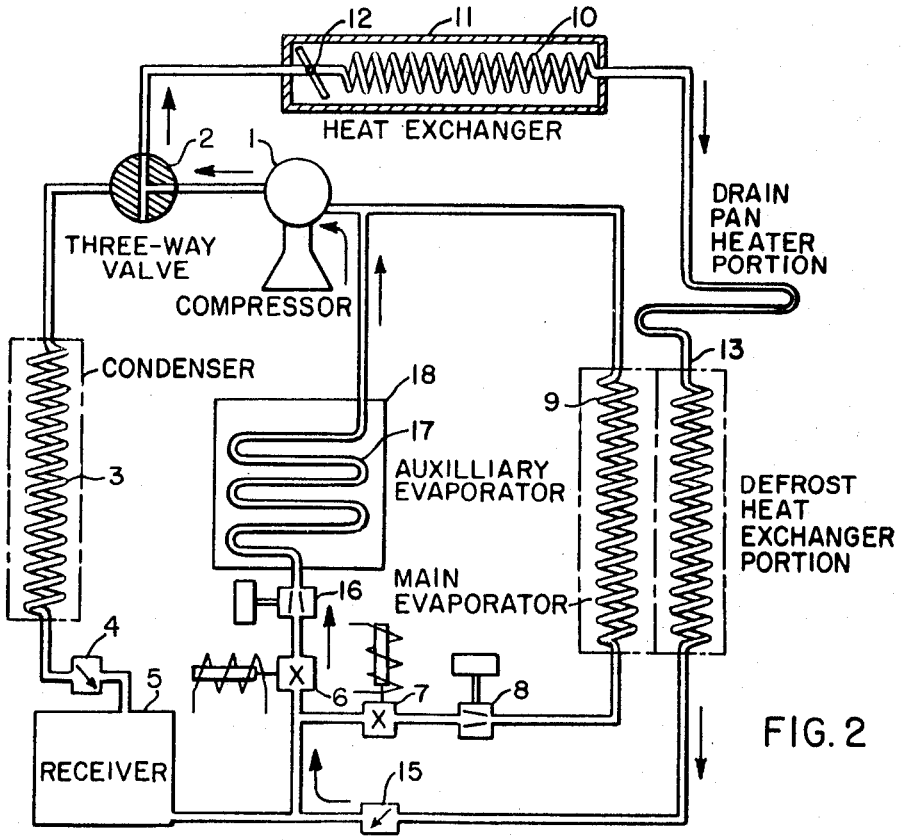
FIG. 2 is a schematic diagram of the system with the valves positioned so the system will produce a heating or defrost cycle.

In FIG. 2, the valves of the system are set so the system will operate to produce a heating or defrost cycle. Three way valve 2 has been changed to the position shown, solenoid operated valve 6 has been opened and solenoid operated valve 7 has been closed. Refrigerant is compressed in compressor 1 and is pumped through three way valve 2 to a first heat exchanger 10. First heat exchanger 10 is enclosed by a tubular casing 11 and at one end of the casing is an adjustable damper 12. In the cycle of FIG. 2, damper 12 is closed to prohibit the flow of air over heat exchanger 10. Thus, practically no heat of compression is lost in the first heat exchanger 10 during this cycle. From first heat exchanger 10 the hot compressed refrigerant passes through a second heat exchanger 13 consisting of a drain pan heater portion and a defrost heat exchanger portion. In this cycle illustrated in FIG. 2 no refrigerant passes through main evaporator 9 so the second heat exchanger 13 will rapidly defrost main evaporator 9 and a drain pan for evaporator 9. The compressed refrigerant is condensed in heat exchanger 13 and the liquid refrigerant passes through a check valve 15, through solenoid operated valve 6 which is open, and an expansion valve 16, to an auxiliary evaporator 17. The liquid refrigerant evaporates in auxiliary evaporator 17 and refrigerant vapor returns to compressor 1.

Auxiliary evaporator 17 is shown enclosed in a container 18 filled with a heat holdover. The holdover material can be washing soda or a similar eutectic salt to rapidly give up heat to auxiliary evaporator 17. However, auxiliary evaporator 17 can be heated by the ambient air, waste heat, or an electric heater.

Figure 3:
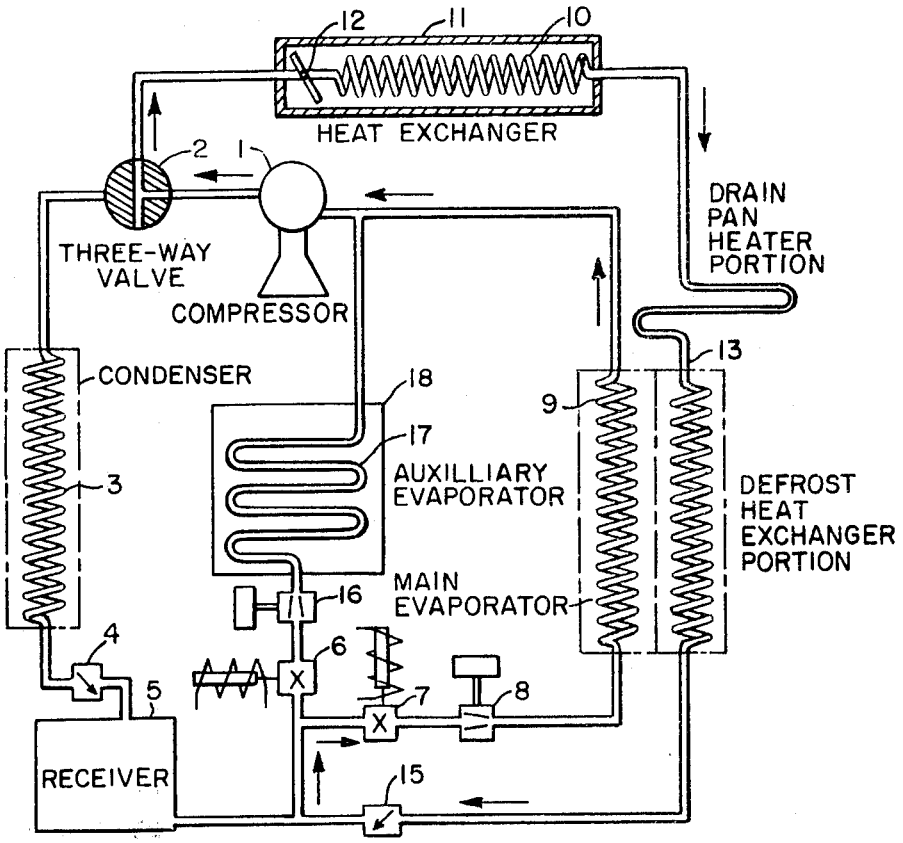
FIG. 3 is a schematic diagram of the system with the valves set so the system will produce a capacity controlled refrigeration cycle.

In FIG. 3 the valves of the system are set so the system will operate to produce a refrigeration cycle with a capacity control for the cooling produced by the evaporator. Three way valve 2 is in the same position as shown in FIG. 2. Solenoid operated valve 6 is closed and solenoid operated valve 7 is opened. Refrigerant is compressed in compressor 1 and flows through three way valve 2 to first heat exchanger 10. If damper 12 is not completely closed some of the heat of compression of the refrigerant will be dissipated to atmosphere. Depending upon the amount damper 12 is open there could be but a minor dissipation of the heating effect of the compressed refrigerant or if the damper 12 is fully open the heating effect of the refrigerant could be reduced to near zero. From first heat exchanger 10 the compressed refrigerant passes through second heat exchanger 13 and any refrigerant that has not been condensed by the time it reaches second heat exchanger 13 will be condensed and the latent heat of condensation will be balanced against the heat of evaporation in main evaporator 9. From heat exchanger 13 the liquid refrigerant passes through check valve 15, solenoid operated valve 7, and expansion valve 8 to main evaporator 9. From the main evaporator 9 refrigerant vapor returns to compressor 1. Thus, in the cycle of FIG. 3, main evaporator 9 is functioning and the amount of heat given off by heat exchanger 13 to counteract the cooling effect of main evaporator 9 will depend on the amount of heat that was not dissipated from the compressed gas in passing through first heat exchanger 10.

Figure 4:
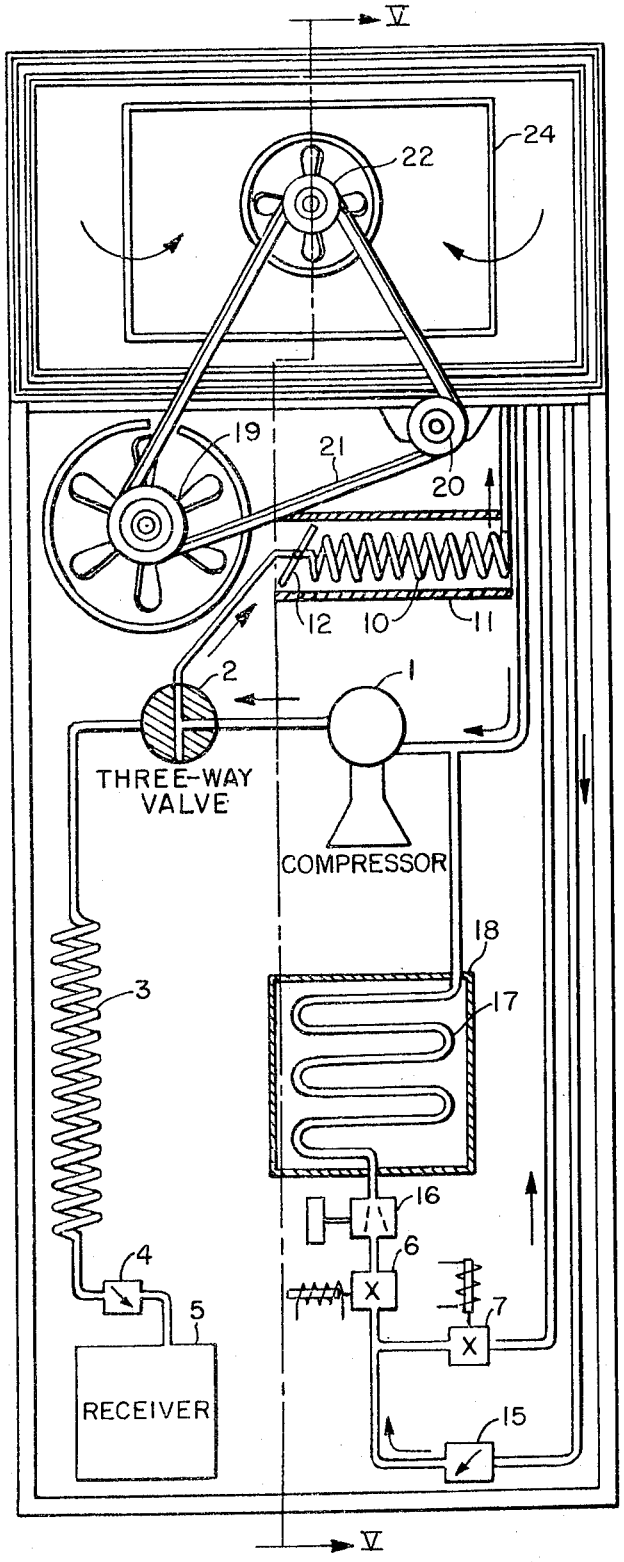
FIG. 4 is an arrangement of the system within an air conditioning unit.

FIG. 4 is a back view of an air conditioning unit with the system arranged therein. To show the elements of the system, the back plates of the unit have all been omitted in FIG. 4 except for a portion of a plate near a fan 19.

A motor drive 20 drives a belt 21 which in turn drives fan 19 and a fan 22. The two sides of the unit from a point along side the fan 19 to the bottom of the unit are an open grille. The back of the unit from a point at the bottom of fan 19 to the bottom of the unit and the portion to the right of fan 19 are an open grille. Thus, fan 19 draws air into the unit and past the elements that it is desired to withdraw heat from, that is compressor 1, condenser 3, receiver 5, and holdover container 18. Fan 19 will draw air through first heat exchanger 10 depending upon the extent to which damper 12 is open. Fan 19 expells the air drawn over the heat rejecting units out through an opening in a rear panel.

Figure 5:
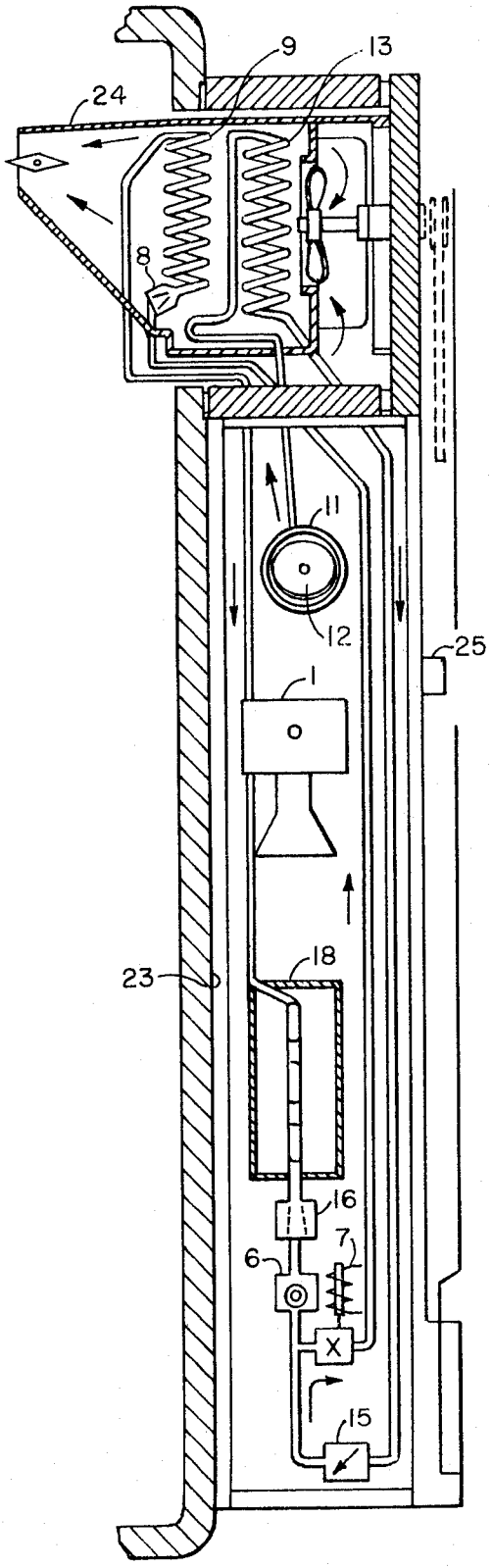
FIG. 5 is a cross section of the unit taken on line V—V of FIG. 4 and shows the unit positioned on a vehicle.

FIG. 5 is a cross section taken on line V—V of the unit of FIG. 4 and is shown mounted on a wall 23 of the space to be air conditioned. As shown in FIGS. 4 and 5, fan 22 draws air from the space to be air conditioned and forces the air over heat exchanger 13, main evaporator 9, and back into the space to be air conditioned. This is accomplished by fan 19 drawing air from the space to be conditioned by pulling said air around the bottom and two sides of an enclosure 24 and then forcing the air through the enclosure back into the space to be conditioned. The bottom of enclosure 24 will serve as a drain pan for main evaporator 9. A portion of second heat exchanger 13 is in heat exchange relation with the bottom of enclosure 24.

In FIGS. 4 and 5 the valves are set in the same positions they are set in FIG. 3, that is, three way valve 2 is positioned so that refrigerant from the compressor 1 is pumped to first heat exchanger 10, solenoid operated valve 6 is closed, and solenoid operated valve 7 is opened.

In FIG. 5, at the back of the unit a manual control knob 25 is shown. A disc secured to this knob is properly marked and controls a number of electrical switches that energize the motor for compressor 1, the motor drive 20, the turning means for three way valve 2, solenoid operated valve 6, solenoid operated valve 7 and the turning means for damper 12.

SOME ALTERNATIVE ELEMENTS THAT MAY BE USED IN THE SYSTEM

The two solenoid operated valves 6 and 7 could be replaced by a single three way valve thus reducing the valves in the main refrigeration and heating system to two three-way valves, two check valves, and two expansion valves.

The drive means for compressor 1 and motor drive 20 may be engine driven, electric driven, or combination drive units.

The system provides a capacity control well suited to systems such as a diesel drive where a prime mover runs continuously.

I claim:

1. In a system for refrigeration, heating and defrosting, comprising a compressor, a three way valve, a condenser, a first check valve, a first solenoid operated valve, a first expansion valve, a main evaporator, a first heat exchanger, a second heat exchanger adjacent said main evaporator, a second check valve, a second solenoid operated valve, a second expansion valve, an auxiliary evaporator, and means for connecting the above named elements so that when the three way valve is in a first position with the first solenoid operated valve open and the second solenoid operated valve closed, refrigerant will flow from the compressor through the three way valve, the condenser, the first check valve, the first solenoid operated valve, the first expansion valve, the main evaporator, and back to the compressor, and when the three way valve is moved to a second position with the first solenoid operated valve closed and the second solenoid operated valve opened, refrigerant will flow from the compressor through the three way valve, the first heat exchanger, the second heat exchanger, the second check valve, the second solenoid operated valve, the second expansion valve, the auxiliary evaporator and back to the compressor; and adjustable means surrounding the first heat exchanger to control the amount of heat of compression dissipated by the first heat exchanger.

2. In a system as set forth in claim 1, drain pan beneath the evaporator and said second heat exchanger has a portion forming a heater for the drain pan and a portion forming a defrost heat exchanger.

3. In a system as set forth in claim 1, said auxiliary evaporator being heated by ambient air.

4. In a system as set forth in claim 1, a casing enclosing the auxiliary evaporator, and said casing containing an eutectic salt.

5. In a system as set forth in claim 1, means for heating the auxiliary evaporator with waste heat.

6. In a system as set forth in claim 1, an electric heater for heating the auxiliary evaporator.

7. In a system as set forth in claim 1, in which the means for connecting the elements is such that when the three way valve is in the second position with the first solenoid operated valve open and the second solenoid operated valve closed, refrigerant will flow from the compressor through the three way valve, the first heat exchanger, the second heat exchanger, the second check valve, the first solenoid operated valve, the first expansion valve, the main evaporator and back to the compressor, whereby the amount of heat dissipated from the first heat exchanger will determine the amount of heat available from the second heat exchanger to counteract the cooling effect of the main evaporator.

8. In a system as set forth in claim 7, means for circulating air to be conditioned first past the second heat exchanger and then past the evaporator.

* * * * *